United States Patent [19]

Schipske

[11] Patent Number: 4,718,668

[45] Date of Patent: Jan. 12, 1988

[54] UNIVERSAL TENNIS TRAINING MEANS

[76] Inventor: Donald Schipske, 347 Massachusetts Ave., Trenton, N.J. 08629

[21] Appl. No.: 851,848

[22] Filed: Apr. 14, 1986

[51] Int. Cl.[4] ..... A63B 69/38

[52] U.S. Cl. ..... 273/29 A; 273/26 A

[58] Field of Search ..... 273/26 A, 29 A, 410, 273/411, 127 R, 1.5 A, 181 K, 181 F; 272/101, 102, 103, 104; 464/227, 486

[56] References Cited

U.S. PATENT DOCUMENTS

| | | | |
|---|---|---|---|
| 1,510,402 | 9/1924 | Hopwood | 273/29 A |
| 3,013,801 | 12/1961 | Kirkconnell, Jr. | 273/181 K |
| 3,180,643 | 4/1965 | Kallai | 273/29 A |
| 3,563,544 | 2/1971 | Hedrick | 273/29 A |
| 3,583,703 | 6/1971 | Brown et al. | 273/26 A |
| 3,601,398 | 8/1971 | Brochman | 273/26 E |
| 3,836,144 | 9/1974 | Mahoney | 273/1.5 A |
| 3,918,711 | 11/1975 | Zak | 273/29 A |
| 3,966,205 | 6/1976 | Schain | 273/29 A |
| 4,082,271 | 4/1978 | Martin | 273/29 A |
| 4,127,267 | 11/1978 | Bay et al. | 273/26 A |
| 4,160,549 | 7/1979 | Simpson | 273/29 A |
| 4,206,916 | 6/1980 | Epply | 273/29 A |
| 4,295,648 | 10/1981 | Stromback | 273/29 A |
| 4,456,251 | 6/1984 | Balaz | 273/29 A |
| 4,489,941 | 12/1984 | Shieh | 273/26 A |
| 4,502,685 | 3/1985 | Phillips et al. | 273/29 A |
| 4,627,588 | 12/1986 | Block | 446/227 |

*Primary Examiner*—Richard C. Pinkham
*Assistant Examiner*—T. Brown
*Attorney, Agent, or Firm*—Sperry, Zoda & Kane

[57] ABSTRACT

A tennis training device is disclosed including a plurality of telescoping sections in order to provide an infinitely variable opening through which a tennis ball may be struck. The device may be placed adjacent to a net or at any particular targeted location upon a tennis court. The device includes support members which are adapted to selectively receive ballast material therein such as water or sand in order to provide a stable training device which can be simply made portable by removal of the ballast material from therein. Reduction couplings are used to facilitate the telescoping interaction and expandability and retractability of the device. Aperture and pin configurations are used to fix the vertically telescoping members into a specific location during use. Preferably the device may be formed of polyvinylchloride tubing members.

21 Claims, 4 Drawing Figures

UNIVERSAL TENNIS TRAINING MEANS

BACKGROUND OF THE INVENTION

1. Field of the Invention

The present invention provides a universally usable tennis training device which is pertinent to the field of such targets. Normally such targets include a net means of some sort for gathering of the balls directed therethrough.

These devices may be placed adjacent to a net for targeting or may be positioned at various locations around the court or may be used without a tennis court at all but merely for targeting of ground strokes, serves or volleys.

2. Description of the Prior Art

Many devices have been designed for the training of tennis players such as shown in U.S. Pat. No. 1,510,402 patented Sept. 30, 1924 to W. Hopwood for an Appliance For Playing Games Resembling Law Tennis and; U.S. Pat. No. 3,013,801 patented Dec. 19, 1961 to O. A. Kirkconnell, Jr. on a Simulated Golf Fairway; U.S. Pat. No. 3,180,643 patented Apr. 27, 1965 to O. Kallai on a Tennis Training Apparatus; U.S. Pat. No. 3,563,544 patented Feb. 16, 1971 to Andrew J. Hedrick on a Portable Tennis Instruction And Practice Board; U.S. Pat. No. 3,583,703 patented June 8, 1971 to William S. Brown on Practice Pitching Devices; U.S. Pat. No. 3,836,144 patented Sept. 17, 1974 to Elmo J. Mahoney on a Portable Projectile Return Apparatus; U.S. Pat. No. 3,918,711 patented Nov. 11, 1975 to Thomas J. Zak on a Tennis Training Ball Target And Projector; U.S. Pat. No. 3,966,205 patented June 29, 1976 to David B. Schain et al. on a Tennis Serve Practice Device And Method Of Using Same; U.S. Pat. No. 4,082,271 patented Apr. 4, 1978 to Arthur Lee Martin on a Tennis Practice And Teaching Rebounder; U.S. Pat. No. 4,127,267 patented Nov. 28, 1978 to Marvon W. Bay et al. on a Collapsible Frame With Hanging Net Ball Arresting Apparatus; U.S. Pat. No. 4,160,549 patented July 10, 1979 to John P. Simpson on a Tennis Serve Training and Practice Device; U.S. Pat. No. 4,206,916 patented June 10, 1980 to William R. Epply on a Tensioned Net; U.S. Pat. No. 4,295,648 patented Oct. 20, 1981 to Theodore D. Stromback on a Baseball Pitcher's Target; U.S. Pat. No. 4,456,251 patented June 26, 1981 to Anton Balaz on a Tennis Ball Rebound Practice Net; U.S. Pat. No. 4,489,941 patented Dec. 25, 1984 to Shin-Shi Shieh on a Sports Net Apparatus; and U.S. Pat. No. 4,502,685 patented Mar. 5, 1985 to Vanice C. Phillips et al. on a Tennis Serve Practice Device.

SUMMARY OF THE INVENTION

The present invention provides a universal tennis training device which includes a first support member which extends horizontally and is adapted to be placed upon the surface of the tennis court or playing surface. This first support member defines a hollow first support chamber therein which is adapted to receive a ballast material such as water or sand to facilitate stabilizing of this otherwise portable tennis training device.

The first support member further defines a first access hole therein such as to allow for easy placement and removal of the ballast material into and out of the first hollow support chamber.

A first lower vertical member is fixedly secured preferably perpendicularly with respect to the first support member to extend vertically upward therefrom. Furthermore a first lower horizontal member is fixedly secured with respect to the first lower vertical member preferably perpendicularly with respect thereto and extends outwardly horizontally therefrom.

A second support member is preferably positioned extending horizontally along the upper surface of the ground in spaced relation with respect to the first support member. This second support member will define a second hollow support chamber therein such as to receive ballast material for stabilization of the entire device in a similar manner as with respect to the first support member. Also the second support member will define a second access hole therein which facilitates placement and removal of ballast material in the second hollow support chamber. A second lower vertical member is fixedly secured with respect to the second support member and extends vertically upward therefrom and is preferably perpendicular with respect thereto. A second lower horizontal member is fixedly secured with respect to the second lower vertical member and extends outwardly preferably horizontally therefrom toward the first lower horizontal member. The second lower horizontal member is telescopically engageable with respect to the first lower horizontal member to allow for changes in the lateral spacing therebetween to control the distance between the first lower vertical member and the second lower vertical member.

A first upper vertical member is positioned extending upwardly preferably co-axially with respect to the first lower vertical member and is telescopically engageable therewith. A first upper horizontal member is fixedly secured with respect to the first upper vertical member and extends approximately horizontally outward therefrom and is preferably perpendicular with respect thereto.

A second upper vertical member extends outwardly from the second lower vertical member and is preferably co-axial therewith such as to be telescopically engageable therewith.

A second upper horizontal member is fixedly secured with respect to the second upper vertical member and extends approximately horizontally outwardly therefrom and is preferably perpendicular with respect thereto. The second upper horizontal member extends toward the first upper horizontal member in such a manner as to be co-axial therewith and to be telescopically engaged therewith to facilitate changes in the lateral spacing between the first upper vertical member and the second upper vertical member.

A first plug member is capable of being screwed or otherwise secured into the first access hole to thereby facilitate the retaining of ballast material within the first hollow support chamber. Similarly, a second plug is selectively positionable into the second access hole to retain ballast material within the second hollow support chamber.

Preferably the first upper vertical member includes a first vertical locking means to allow detachable securement of the first upper vertical member with respect to the first lower vertical member to maintain a pre-chosen spacing between the first and second lower horizontal member and the first and second upper horizontal member. This dimension determines the vertical spacing of the target area of the universal tennis training device of the present invention.

The first upper vertical member will preferably define a plurality of first locking aperatures therein and will also include a first pin which is positionable extending through these apertures to achieve the vertical locking of the first vertical locking means described above.

In a similar manner the second upper vertical member may include a second vertical locking means thereon to fixedly secure the second upper vertical member with respect to the second lower vertical member. This locking means may take the form of a plurality of second locking apertures defined in the second upper vertical member used in combination with a second pin positionable extending through these second apertures to selectively achieve fixed securement of the second upper vertical member with respect to the second lower vertical member for maintaining vertical spacing of the target area of the universal tennis training device of the present invention.

A first reduction coupling means may be positioned between the first lower vertical member and the first upper vertical member to facilitate telescopic movement therebetween. Similarly, a second reduction coupling may be positioned between the second lower vertical member and the second upper vertical member to facilitate telescopic movement therebetween.

An upper reduction coupling means may be positioned between the first upper horizontal member and the second upper horizontal member to facilitate telescopic movement therebetween. Also a lower reduction coupling may be positioned between the first lower horizontal member and the second lower horizontal member to facilitate telescopic movement therebetween.

It is preferable that the various members of the present invention be formed of polyvinylchloride tubing with some sections being of two inch diameter and other sections being of one and one half inch diameter to facilitate telescopic engagement of adjacent members with respect to one another.

It is an object of the present invention to provide a universal tennis training means wherein an overall light weight construction is achieved.

It is an object of the present invention to provide a universal tennis training means wherein portability is enhanced by ease of assembly and disassembly.

It is an object of the present invention to provide a universal tennis training means wherein PVC tubing is used for all structural members.

It is an object of the present invention to provide a universal tennis training means wherein maintenance requirements are minimal.

It is an object of the present invention to provide a universal tennis training means wherein external weather conditions will not effect any portion of the construction.

It is an object of the present invention to provide a universal tennis training means wherein the target area can be varied from quite small areas for experienced players to quite large areas for novice players.

It is an object of the present invention to provide a universal tennis training means wherein the initial cost outlay for the entire device is minimal.

It is an object of the present invention to provide a universal tennis training means wherein placement can be made adjacent to a net or at any area on a tennis court to facilitate targeting or can be placed on any flat playing area even separate from a specific tennis court.

It is an object of the present invention to provide a universal tennis training means wherein a stable construction is achieved although the individual elements and members of the configuration are light weight.

It is an object of the present invention to provide a universal tennis training means wherein ballasting material can be easily removed or placed into ballasting chambers to facilitate stability of the device.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
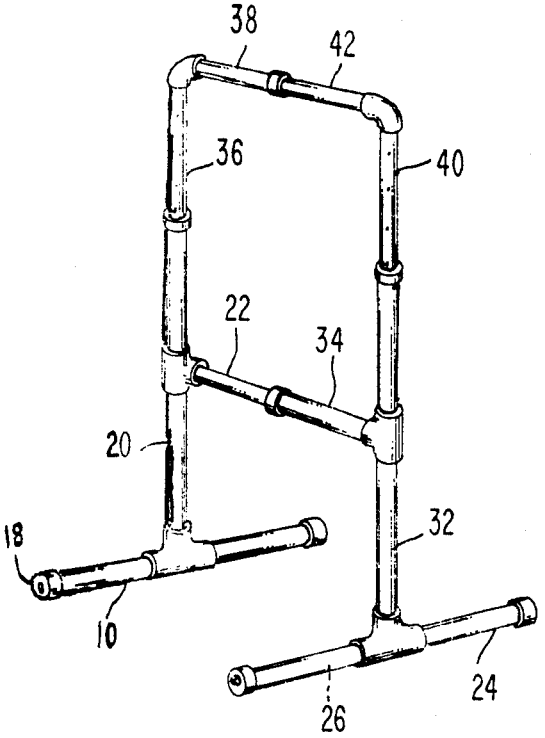
FIG. 1 is a perspective view of an embodiment of the universal tennis training means of the present invention.
Figure 2:
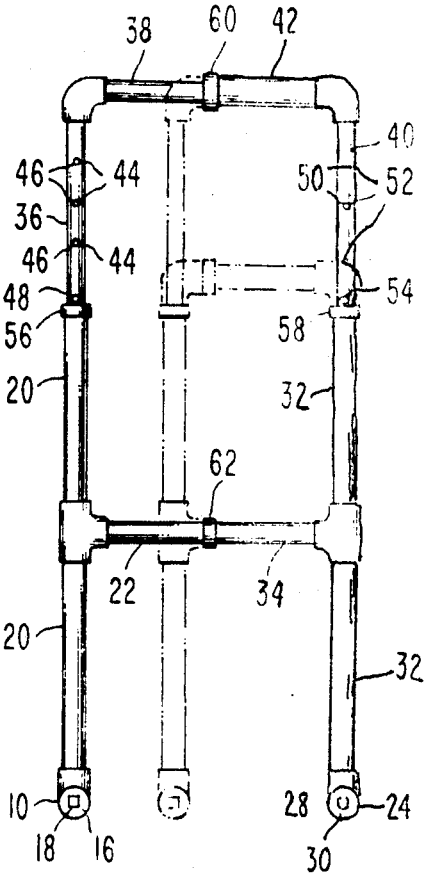
FIG. 2 is a front plan view of the embodiment shown in FIG. 1.
Figure 3:
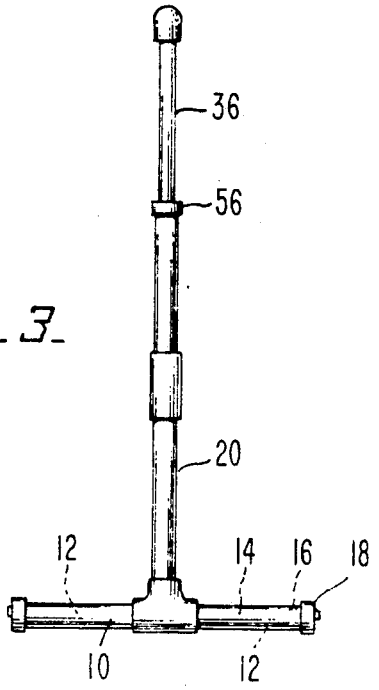
FIG. 3 is a side plan view of the configuration shown in FIG. 2 when viewed from the left.

The universal tennis training means of the present invention includes a first support member 10 as shown in FIGS. 1, 2 and 3 which extends horizontally and is designed to be in abutment with the tennis court surface or the ground surface of the playing area. Preferably this first support member 10 will define a first hollow support chamber 12 therein which is adapted to receive a ballast material 14 such as water or sand therein to maintain said first support member 10 due to the increased weight thereof in a stable position with respect to the ground. Ballast material 14 is added to the first hollow support chamber 12 through a first access hole 16 which may be selectively closed as desired by the usage of a first plug means 18.

A first lower vertical member 20 will preferably be perpendicular with respect to the first support member 10 and will extend vertically upwardly therefrom. A first lower horizontal member 22 will be perpendicularly oriented extending horizontally outward away from the first lower vertical member 20.

Preferably the first support member 10, first lower vertical member 20 and the first lower horizontal member 22 will each be of polyvinylchloride (PVC) tubing.

A second support member 24 will also be adapted to lay on the playing surface horizontally and will define therein a second hollow support chamber 26. This chamber 26 will be adapted to receive ballast material 14 through second access hole 28 which may selectively be closed by a second plug means 30.

A second lower vertical member 32 may be positioned extending perpendicularly upwardly from said second support member 24. Second lower vertical member 32 may have fixedly secured thereto a second lower horizontal member 34 extending horizontally and perpendicularly with respect thereto. Preferably the second lower horizontal member 34 and the first lower horizontal member 22 will be telescopically engageable with respect to one another. This is achievable by having the diameter of tubing chosen for these two members to be different in dimension from the other member to allow slidable telescoping engagement therebetween. This could be achieved as shown in FIG. 2 by second lower horizontal member 34 being chosen of a two inch diameter PVC tubing and first lower horizontal member 22 being chosen of a one and one-half inch tubing diameter. This interconnection can be facilitated by the use of a lower reduction coupling means 62 which has a section having outside diameter equal to the inside diameter of the larger lower horizontal member and having an internal diameter section equal to the outside diameter of the smaller of the two horizontally extending lower members. In this manner slidable engagement therebetween in a telescopic fashion will be facilitated.

The present invention also preferably includes a first upper vertical member 36 co-axially positioned extending upwardly from said first lower vertical member. Preferably first upper vertical member 36 and first lower vertical member 20 will be telescopically and slidably engaged with respect to one another. A first upper horizontal member 38 will extend laterally outwardly and perpendicularly with respect to said first upper vertical member 36 in a direction immediately above first lower horizontal member 22.

In a similar manner a second upper vertical member 40 will be positioned co-axially and immediately above second lower vertical member 32 and will preferably be telescopically slidably engaged therewith. A second upper horizontal member 42 will extend outwardly from the second upper vertical member 40 and will preferably be perpendicular thereto. Second upper horizontal member 42 will extend in the same direction and immediately above the second lower horizontal member 34. Preferably the second upper horizontal member 42 will also be co-axially oriented with respect to the first upper horizontal member 38 such as to be telescopically engaged therewith. In a preferred configuration, second upper horizontal member 42 will be 2 inch PVC tubing and first upper horizontal member will be 1½ inch PVC tubing. An upper reduction coupling means 60 may be positioned therebetween adapted to be fixedly mounted within the inside diameter of the 2 inch second upper horizontal member 44 and slidably engaged with respect to the outside diameter of 1½ inch first upper horizontal member 38. Of course, the sizing of the tubing is merely a matter of choice and the parts could be reversed at the locations of all reduction couplings in the present invention.

A first reduction coupling 56 is preferably positioned between first upper vertical member 36 and first lower vertical member 20 to assure slidable telescoping engagement therebetween. This reduction coupling includes a section thereof having an inside diameter equal to the outside diameter of the smaller of the two adjacent members and includes a section having an outside diameter equal to the inside diameter of the larger of the two piping sections. In this manner slidable engagement between first upper vertical member 36 and first lower vertical member 20 is achieved.

In a similar manner, a second reduction coupling means 58 may be positioned between second lower vertical member 32 and second upper vertical member 40. In the configuration shown in FIG. 2, second lower vertical member 32 is approximately 2 inches in diameter and second upper vertical member 40 is approximately 1½ inches in diameter. Coupling 58 is fixedly mounted inside the internal diameter of second lower vertical member 32 and includes an internal diameter member therein equal to the external diameter of the 1½ inch second upper vertical member 40.

Figure 4:
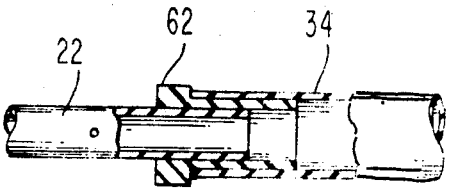
FIG. 4 is a view of an embodiment of the telescoping engagement between the first lower horizontal member 22 and second lower horizontal member 34 through lower reduction coupling means all being illustrative of the telescoping interconnection shown at various locations throughout the means of the present invention.

FIG. 4 shows an exploded view of the inner connecting between a 1½ inch tubing section and a 2 inch tubing section utilizing the reduction coupling means and in particular in this figure the lower reduction coupling means 62. The first lower horizontal member 22 and the second lower horizontal member 34 are shown telescopically engaged thereby.

To facilitate securement of the first upper vertical member 36 and the second upper vertical member 40 with respect to the first lower vertical member 20 and the second lower vertical member 32, a first vertical locking means 44 and a second vertical locking means 50 are included in the present invention.

First vertical locking means 44 includes a plurality of first locking apertures 46 defined in the first upper vertical member 36. A first pin means 48 is selectively positionable extending through the locking apertures to prevent downward sliding of first upper vertical member 36 into the interior of first lower vertical member 20. Preferably the first locking aperture 46 will be spaced vertically with respect to one another along the first upper vertical member 36 to allow a wide range of vertical distance choices.

In a similar manner the second vertical locking means 50 will include a plurality of second locking apertures 52 positioned in spaced relation with respect to one another vertically along second upper vertical member 40. A second pin means 54 is selectively positionable extending through one of the second locking apertures 52 to retain the first upper horizontal member 38 and the second upper horizontal member 42 at the prechosen elevated position. This adjustable characteristic and locking means is a novel characteristic of the present invention.

In this manner, a tennis training device which is universal in nature is shown wherein the size of the target area can be varied from relatively small for experienced players to relatively large for novice players. Also the device itself is extremely portable due to the lightweight hollow construction whereas at the same time allowing maximum stability due to the usage of various ballast materials being placed within the hollow support chambers defined in the members 18 and 24 extending along the ground surface area.

One of the primary uses of the present invention is placement at any chosen location upon a tennis court which could be adjacent to the net or distanced therefrom. During practice between two players, the ball can be repeatedly hit back and forth through the area defined by the various members of this universal tennis training means and in that manner provide continuous play at a high skill level. This is an advantage over prior art devices which always utilize nets to gather the balls rather than allowing the balls to be hit directly through the target areas to facilitate continuous play and continuous reinforcement.

When utilized with polyvinylchloride tubing, the present invention is particularly non-corrosive and can be left in conditions of inclement weather without fear of damage thereto.

Most prior art tennnis training devices utilize either rebounding devices or catching devices for ground strokes or service strokes. The present invention is usable with both types of strokes and in that manner provides a universal training device.

The upper target area between the first and second upper horizontal members and the first and second lower horizontal members defines only one target area. An additional target area is defined between the ground and the first and second horizontally extending lower members. This target area is particularly usable for instruction with respect to volley strokes.

One of the principal advantages of the present invention is the capability of creating a mental image via practice wherein during each stroke the player will have the feeling of "threading the needle" wherein the tennis ball is hit through a specifically sized aperture on a specifically chosen location on the tennis court. This theory of practice and positive reinforcement is encouraged by the openness of the tennis training device which will allow the ball to travel therethrough and illustrate to the player that when the ball is struck through this opening it will also hit the tennis court in such a manner as to make a point. It is much more psychologically satisfying to see the results of a stroke rather than a stroke merely being hit into a net and dropping into a bucket as is normal with the prior art configuration.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A universal tennis training means comprising:

(a) a first support member extending horizontally and defining a first hollow support chamber therein adapted to receive ballast material to facilitate stabilization of the universal tennis training means, said first support member defining a first access hole therein in fluid flow communication with respect to said first hollow support chamber to selectively allow placement and removal of ballast material therein;

(b) a first lower vertical member fixedly secured with respect to said first support member and extending vertically upward therefrom;

(c) a first lower horizontal member fixedly secured with respect to said first lower vertical member and extending outwardly horizontally therefrom;

(d) a second support member extending horizontally and defining a second hollow support chamber therein adapted to receive ballast material therein to facilitate stabilization of the universal tennis training means, said second support member defining a second access hole therein in fluid flow communication with respect to said second hollow support chamber to selectively allow placement and removal of ballast material therein;

(e) a second lower vertical member fixedly secured with respect to said second support member and extending vertically upward therefrom;

(f) a second lower horizontal member fixedly secured with respect to said second lower vertical member and extending outwardly horizontally therefrom toward said first lower horizontal member, said second lower horizontal member being telescopically engageable with respect to said first lower horizontal member to an extent equal to at least substantially one half of the length thereof to allow for changes in the lateral spacing between said first lower vertical member and said second lower vertical member;

(g) a first upper vertical member extending upwardly from said first lower vertical member and being telescopically engageable therewith to an extent equal to at least substantially one half of the length thereof;

(h) a first upper horizontal member being fixedly secured with respect to said first upper vertical member and extending approximately horizontally outwardly therefrom;

(i) a second upper vertical member extending upwardly from said second lower vertical member and being telescopically engageable therewith to an extent equal to at least substantially one half of the length thereof;

(j) a second upper horizontal member being fixedly secured with respect to said second upper vertical member and extending approximately horizontally outwardly therefrom toward said first upper horizontal member and being telescopically engageable therewith to an extent equal to at least substantially one half of the length thereof to allow for changes in the lateral spacing between said first upper vertical member and said second upper vertical member;

(k) a first sealing means selectively positionable at said first access hole to retain ballast material within said first hollow support chamber; and (l) a second sealing means selectively positionable at said second access hole to retain ballast material within said second hollow support chamber.

2. The universal tennis training means as defined in claim 1 wherein said first upper vertical member includes a first vertical locking means thereon to selectively fixedly secure said first upper vertical member with respect to said first lower vertical member.

3. The universal tennis training means as defined in claim 2 wherein said first upper vertical member defines a plurality of first locking apertures therealong and wherein said first vertical locking means comprises a first pin means positionable extending through said first locking apertures to selectively fixedly secure said first upper vertical member with respect to said first lower vertical member.

4. The universal tennis training means as defined in claim 1 wherein said second upper vertical member includes a second vertical locking means thereon to selectively fixedly secure said second upper vertical member with respect to said second lower vertical member.

5. The universal tennis training means as defined in claim 4 wherein said second upper vertical member defines a plurality of second locking apertures therealong and wherein said second vertical locking means comprises a second pin means positionable extending through said second locking apertures to selectively fixedly secure said second upper vertical member with respect to said second lower vertical member.

6. The universal tennis training device as defined in claim 1 wherein said first lower horizontal member is oriented perpendicularly with respect to said first lower vertical member.

7. The universal tennis training device as defined in claim 1 wherein said second lower horizontal member is oriented perpendicularly with respect to said second lower vertical member.

8. The universal tennis training device as defined in claim 1 wherein said first upper horizontal member is oriented perpendicularly with respect to said first upper vertical member.

9. The universal tennis training device as defined in claim 1 wherein said second upper horizontal member is oriented perpendicularly with respect to said second upper vertical member.

10. The universal tennis training device as defined in claim 1 further comprising a first reduction coupling means positioned between said first lower vertical member and said first upper vertical member to facilitate telescopic movement therebetween.

11. The universal tennis training device as defined in claim 1 further comprising a second reduction coupling means positioned between said second lower vertical member and said second upper vertical member to facilitate telescopic movement therebetween.

12. The universal tennis training device as defined in claim 1 further comprising an upper reduction coupling means positioned between said first upper horizontal member and said second upper horizontal member to facilitate telescopic movement therebetween.

13. The universal tennis training device as defined in claim 1 further comprising a lower reduction coupling means positioned between said first lower horizontal member and said second lower horizontal member to facilitate telescopic movement therebetween.

14. The universal tennis training device as defined in claim 1 further including ballast material positioned within said first hollow support chamber and said second hollow support chamber wherein said ballast material is water.

15. The universal tennis training device as defined in claim 1 further including ballast material positioned within said first hollow support chamber and said second hollow support chamber wherein said ballast material is sand.

16. The universal tennis training device as defined in claim 1 wherein all of said members thereof are made of polyvinylchloride tubing.

17. The universal tennis training device as defined in claim 1 wherein said first lower vertical member is oriented parallel with respect to said second lower vertical member.

18. The universal tennis training device as defined in claim 1 wherein said first upper vertical member is oriented parallel with respect to said second upper vertical member.

19. The universal tennis training device as defined in claim 1 wherein said first upper horizontal member is oriented parallel with respect to said first lower horizontal member.

20. The universal tennis training device as defined in claim 1 wherein said second upper horizontal member is oriented parallel with respect to said second lower horizontal member.

21. A universal training means comprising:

(a) a first support member of PVC tubing extending horizontally and defining a first hollow support chamber therein adapted to receive ballast material to facilitate stabilization of the universal tennis training means, said first support member defining a first access hole therein in fluid flow communication with respect to said first hollow support chamber to selectively allow placement and removal of ballast material therein;

(b) a first lower vertical member of PVC tubing fixedly secured with respect to said first support member and extending vertically upward perpendicularly therefrom;

(c) a first lower horizontal member of PVC tubing fixedly secured with respect to said first lower vertical member and extending outwardly horizontally therefrom, said first lower horizontal member being oriented perpendicularly with respect to said first lower vertical member and with respect to said first support member;

(d) a second support member of PVC tubing extending horizontally and defining a second hollow support chamber therein adapted to receive ballast material therein to facilitate stabilization of the universal tennis training means, said second support member defining a second access hole therein in fluid flow communication with respect to said second hollow support chamber to selectively allow placement and removal of ballast material therein;

(e) a second lower vertical member of PVC tubing fixedly secured with respect to said second support member and extending vertically upward perpendicularly therefrom;

(f) a second lower horizontal member of PVC tubing fixedly secured with respect to said second lower vertical member and extending outwardly horizontally therefrom toward said first lower horizontal member, said second lower horizontal member being oriented perpendicularly with respect to said second lower vertical member and with respect to said second support member, said second lower horizontal member being telescopically engageable to an extent equal to at least substantially one half of the length thereof with respect to said first lower horizontal member to allow for changes in the lateral spacing between said first lower vertical member and said second lower vertical member;

(g) a first upper vertical member of PVC tubing extending upwardly from said first lower vertical member and being telescopically engageable therewith to an extent equal to at least substantially one half of the length thereof, said first upper vertical member defining a plurality of first locking apertures therealong, said first upper vertical member including a first vertical locking means thereon to selectively secure said first upper vertical member with respect to said first lower vertical member, said first vertical locking means including a first pin means selectively positionable extending through said first locking apertures;

(h) a first upper horizontal member of PVC tubing being fixedly secured with respect to said first upper vertical member and extending approximately horizontally and perpendicularly outwardly therefrom;

(i) a second upper vertical member of PVC tubing extending upwardly from said second lower vertical member and being telescopically engageable therewith to an extent equal to at least substantially one half of the length thereof, said second upper vertical member defining a plurality of second locking apertures therealong, said second upper vertical member including a second vertical locking means thereon to selectively fixedly secure said second upper vertical member with respect to said second lower vertical member, said second vertical locking means including a second pin means selectively positionable extending through said second locking apertures;

(j) a second upper horizontal member of PVC tubing being fixedly secured with respect to said second upper vertical member and extending approximately horizontally and perpendicularly outwardly therefrom toward said first upper horizontal member and being telescopically engageable therewith to an extent equal to at least substantially one half of the length thereof to allow for changes in the lateral spacing between said first upper vertical member and said second upper vertical member;

(k) a first reduction coupling means positioned between said first lower vertical member and said first upper vertical member to facilitate telescopic movement therebetween;

(l) a second reduction coupling means positioned between said second lower vertical member and said second upper vertical member to facilitate telescopic movement therebetween;

(m) an upper reduction coupling means positioned between said first upper horizontal member and said second upper horizontal member to facilitate telescopic movement therebetween;

(n) a lower reduction coupling means positioned between said first lower horizontal member and said second lower horizontal member to facilitate telescopic movement therebetween;

(o) a first capping means selectively positionable at said first access hole to retain ballast material within said first hollow support chamber; and (p) a second capping means selectively positionable at said second access hole to retain ballast material within said second hollow support chamber.

* * * * *